US012156588B2

(12) United States Patent
Wainless et al.

(10) Patent No.: US 12,156,588 B2
(45) Date of Patent: Dec. 3, 2024

(54) PERSONAL CARE IMPLEMENT WITH REPLACEMENT HEAD

(71) Applicant: Colgate-Palmolive Company, New York, NY (US)

(72) Inventors: Daniel Wainless, New Brunswick, NJ (US); Douglas Hohlbein, Hopewell, NJ (US); Douglas Henderson, Basking Ridge, NJ (US); Thuan Chong Tan, Shanghai (CN); Pengyang Fu, Shanghai (CN)

(73) Assignee: Colgate-Palmolive Company, New York, NY (US)

( * ) Notice: Subject to any disclaimer, the term of this patent is extended or adjusted under 35 U.S.C. 154(b) by 589 days.

(21) Appl. No.: 17/493,109

(22) Filed: Oct. 4, 2021

(65) Prior Publication Data

US 2022/0022636 A1 Jan. 27, 2022

Related U.S. Application Data

(62) Division of application No. 16/464,324, filed as application No. PCT/US2017/062920 on Nov. 22, 2017, now Pat. No. 11,160,358.

(30) Foreign Application Priority Data

Nov. 28, 2016 (CN) ..... 201611069616.X

(51) Int. Cl.
*A46B 9/04* (2006.01)
*A46B 5/00* (2006.01)

(52) U.S. Cl.
CPC ..... *A46B 9/04* (2013.01); *A46B 5/0095* (2013.01); *A46B 2200/1066* (2013.01)

(58) Field of Classification Search
CPC .. A46B 9/04; A46B 5/0095; A46B 2200/1066
See application file for complete search history.

(56) References Cited

U.S. PATENT DOCUMENTS 5,133,102 A 7/1992 Sakuma
5,365,627 A 11/1994 Jousson et al.
(Continued)

FOREIGN PATENT DOCUMENTS

CN 1893853 A 1/2007
CN 203388461 1/2014
(Continued)

OTHER PUBLICATIONS

International Search Report and Written Opinion of the International Searching Authority in International Application No. PCT/US2017/062920, mailed Mar. 12, 2018.

*Primary Examiner* — Shay Karls

(57) ABSTRACT

A personal care implement includes a treatment device having a longitudinal axis and including a treatment portion having at least one treatment element; a connection portion having a main body and a first resilient snap attachment protruding from the main body, the main body formed of a first material having a first hardness and the first resilient snap attachment formed of a second material having a second hardness, the first hardness being greater than the second hardness; and the treatment device is alterable between: (1) a detached state; and (2) an assembled state in which the treatment device is detachably coupled to a grip section such that the first resilient snap attachment cooperates with and engages a first engagement portion of the grip section to secure the treatment device to the grip section.

20 Claims, 13 Drawing Sheets

(56) References Cited

U.S. PATENT DOCUMENTS

| | | | | |
|---|---|---|---|---|
| 5,774,921 | A | 7/1998 | Harrison et al. | |
| 5,875,510 | A * | 3/1999 | Lamond | A46B 5/0095 15/176.6 |
| 6,145,152 | A | 11/2000 | Ward | |
| 6,546,585 | B1 | 4/2003 | Blaustein et al. | |
| D899,094 | S | 10/2020 | Wainless et al. | |
| 2004/0187889 | A1 | 9/2004 | Kemp et al. | |
| 2007/0256262 | A1* | 11/2007 | Moss | A61C 17/3418 15/176.1 |
| 2021/0106131 | A1 | 4/2021 | Wainless et al. | |

FOREIGN PATENT DOCUMENTS

| | | | |
|---|---|---|---|
| WO | 2004/019728 | 3/2004 | |
| WO | 2005/030002 | 4/2005 | |
| WO | WO-2013009361 A1 * | 1/2013 | A61C 17/222 |
| WO | 2018/098211 | 5/2018 | |

* cited by examiner

PERSONAL CARE IMPLEMENT WITH REPLACEMENT HEAD

CROSS-REFERENCE TO RELATED APPLICATIONS

The present application is a divisional of U.S. patent application Ser. No. 16/464,324, filed May 28, 2019, which is a national stage application under 35 U.S.C. § 371 of PCT/US2017/062920, filed Nov. 22, 2017, which claims priority to Chinese Application No. 201611069616.X, filed Nov. 28, 2016, the entireties of which are incorporated herein by reference.

BACKGROUND

Manual toothbrushes having replaceable heads are known in the art. Such manual toothbrushes typically include a body and a replacement head that is detachably coupled to the body. The replaceability of the heads in such manual toothbrushes is desirous for several reasons. Different types of replacement heads/brushes with bristles or other cleaning elements having varying features (for example, without limitation, the hardness of bristles, the length of bristles, the thickness of bristles, the profile of bristles, a combination of several kinds and materials of bristles, the cut shape of bristles, the arrangement of bristles) are designed in accordance with specific purposes of different users (for example, without limitation, periodontal pocket care, interdental care, dental plaque removal, gum stimulation, whitening, polishing) and are also designed to meet varying user preferences (for example, mouth feeling at the time of use). Additionally, the body, which includes the portions held by the user, has a longer life expectancy than does the brush part, i.e. the tooth cleaning elements (and other elements) of the head that perform the cleaning work within the oral cavity. The brush part of a replacement brush/head is a consumable. Accordingly, replacement brushes/heads need to be supplied continuously to users (consumers). It would be inconvenient to a consumer if they had to discard the entirety of the toothbrush when the tooth cleaning elements (or other elements of the head) wore out. In many instances, a user will purchase several replacement heads/brushes in a year's time if he/she regularly uses a toothbrush. Thus, it is has become common in the industry to design the toothbrush body and the head portion to be capable of being detachably coupled to one another, thereby allowing the consumer to replace a worn-out or particular head portion with a new or different head portion at the appropriate time.

Existing replacement heads suffer from a number of deficiencies, including complexity of manufacture of the replacement head, the ability to improperly load the replacement head to the body, and inadequate coupling stability of the replacement head to the body. Thus, a need exists for an improved replacement head connection system, and an oral care implement including the same.

BRIEF SUMMARY

The present invention provides solutions to the above described problems. While the invention is described with regard to a personal care implement that is an oral care implement, it is noted that other non-limiting examples of personal care implements are household brushes, razors, makeup applicators, makeup removers, and other personal care or personal therapeutic products.

In one aspect, the invention is directed to a personal care implement that includes a treatment device having a longitudinal axis and comprising a treatment portion having at least one treatment element; a connection portion having a main body and a first resilient snap attachment protruding from the main body, the main body formed of a first material having a first hardness and the first resilient snap attachment formed of a second material having a second hardness, the first hardness being greater than the second hardness; and the treatment device is alterable between: (1) a detached state; and (2) an assembled state in which the treatment device is detachably coupled to a grip section such that the first resilient snap attachment cooperates with and engages a first engagement portion of the grip section to secure the treatment device to the grip section.

In another aspect, the invention may be a personal care implement that includes a treatment device having a longitudinal axis and comprising a treatment portion having at least one treatment element; a connection portion having a main body and a first resilient snap attachment protruding from the main body; the treatment device is alterable between: (1) a detached state; and (2) an assembled state in which the treatment device is detachably coupled to a grip section such that the first resilient snap attachment cooperates with and engages a first engagement portion of the grip section to secure the treatment device to the grip section; and the connection portion is configured such that during transition from the detached state to the assembled state, the first resilient snap attachment is deflected in a first circumferential direction relative to the longitudinal axis to allow the first resilient snap attachment to pass by the first engagement portion.

In yet another aspect, the invention may be a personal care implement including a treatment device having a longitudinal axis and comprising a treatment portion having at least one treatment element; a connection portion having a main body, a first resilient snap attachment protruding from the main body, and a locating rib protruding from the main body; the locating rib protrudes a height in a radial direction from the main body, the height of the locating rib increasing with longitudinal distance from a distal end of the connection portion; and the treatment device is alterable between: (1) a detached state; and (2) an assembled state in which the treatment device is detachably coupled to a grip section such that the first resilient snap attachment cooperates with and engage a first engagement portion of the grip section to secure the oral treatment device to the grip section.

In yet another aspect, the invention may be a personal care implement that includes a treatment device having a longitudinal axis and comprising a treatment portion having at least one treatment element; a connection receptacle having a first recess located in a first inside surface of the connection receptacle, and a first engagement portion located in the first recess; the first engagement portion extends circumferentially relative to the longitudinal axis in a first circumferential direction; the treatment device is alterable between: (1) a detached state; and (2) an assembled state in which the treatment device is detachably coupled to a grip section such that the first engagement portion cooperates with and engages a first resilient snap attachment of the grip section to secure the treatment device to the grip section, the first resilient snap attachment protruding from a main body of a connection portion of the grip section, the main body formed of a first material having a first hardness and the first resilient snap attachment formed of a second material having a second hardness, the first hardness being greater than the second hardness.

In yet another aspect, the invention may be a personal care implement that includes a treatment device having a longitudinal axis and comprising a treatment portion having at least one treatment element; a connection receptacle having a first recess located in a first inside surface of the connection receptacle, and a first engagement portion located in the first recess; the first engagement portion extends circumferentially relative to the longitudinal axis; the treatment device is alterable between: (1) a detached state; and (2) an assembled state in which the treatment device is detachably coupled to a grip section such that the first engagement portion cooperates with and engages a first resilient snap attachment of a connection portion of the grip section to secure the treatment device to the grip section, the engagement portion is configured such that during transition from the detached state to the assembled state, the first engagement portion deflects the first resilient snap attachment in a first circumferential direction relative to the longitudinal axis to allow the first resilient snap attachment to pass by the first engagement portion.

In yet another aspect, the invention may be a personal care implement that includes a treatment device having a longitudinal axis and comprising a treatment portion having at least one treatment element; a connection receptacle having a first recess located in a first inside surface of the connection receptacle, a first engagement portion located in the first recess, and a rib receiving groove located in a third inside surface of the connection receptacle, the third inside surface and the first inside surface being different surfaces; the first engagement portion extends circumferentially relative to the longitudinal axis; the groove extends into the third inside surface a depth in a radial direction, the depth of the groove decreasing with longitudinal distance from an entrance of the connection receptacle; the treatment device is alterable between: (1) a detached state; and (2) an assembled state in which the treatment device is detachably coupled to a grip section such that the first engagement portion cooperates with and engages a first resilient snap attachment of a connection portion of the grip section to secure the treatment device to the grip section; and the groove is configured to receive a locating rib that protrudes a height in a radial direction from a main body of the connection portion, the height of the locating rib increasing with longitudinal distance from a distal end of the connection portion Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
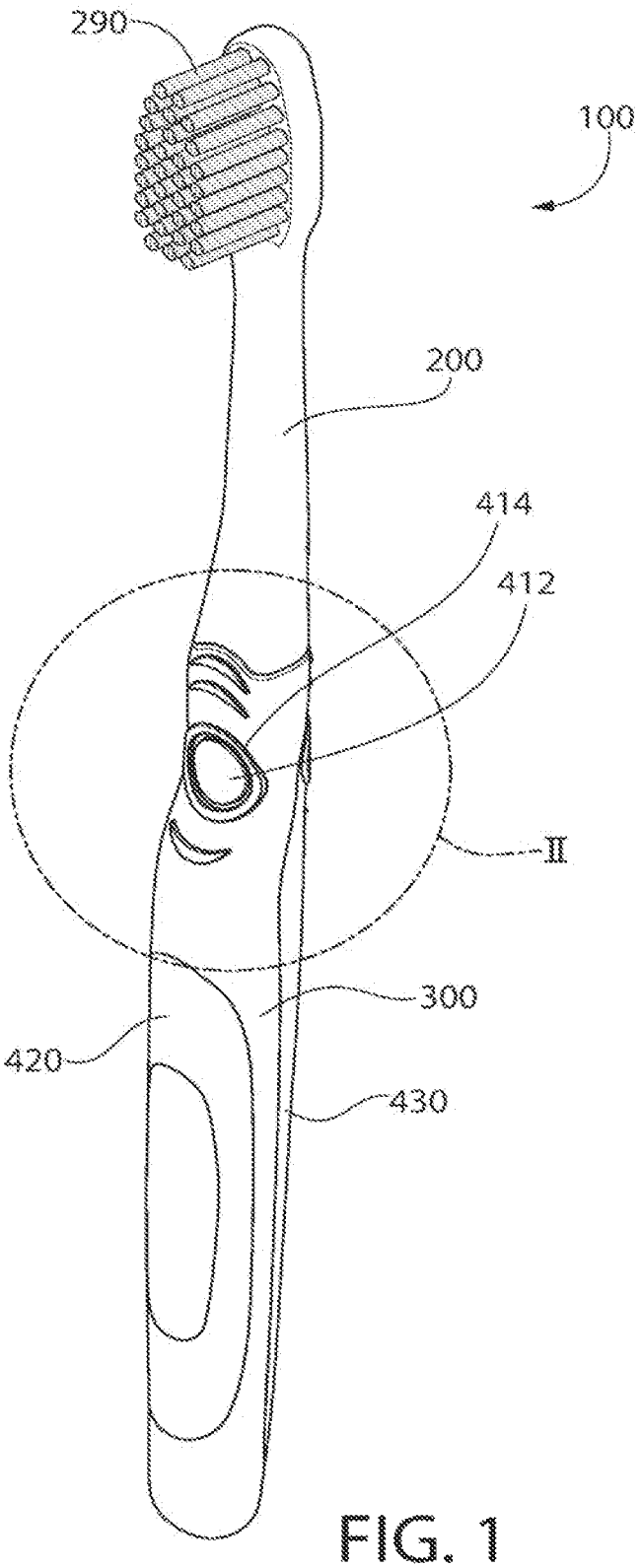
FIG. 1 is a front perspective view of an oral care implement according to exemplary embodiments of the invention.

The following description of embodiments is merely exemplary in nature and is in no way intended to limit the invention, its application, or uses.

With reference to the drawings, hereinafter, description will be given of a manual toothbrush handle and a replacement brush head in embodiments based on the present invention. While the invention is exemplified herein as a manual toothbrush, it is to be understood that the inventive concepts discussed herein can be applied other manual or powered oral care implements, including without limitation, tongue cleaners, water picks, interdental devices, scrapers, mirrors, dispensers for applying material to oral surfaces, tooth polishers and specially designed ansate implements having tooth engaging elements. As a result, while a brush portion is used as the oral treatment device to describe the invention, it is noted that the oral treatment device can be any of the alternate devices listed above, or any other oral treatment device.

The description of illustrative embodiments according to principles of the present invention is intended to be read in connection with the accompanying drawings, which are to be considered part of the entire written description. In each of the following embodiments, if mention is made of counts, quantities and the like, the scope of the present invention is not necessarily limited to the counts, quantities and the like unless otherwise specified. In the respective embodiments to be described below, the same components and corresponding components are denoted with the same reference characters, and therefore the duplicative description is not repeated in some instances.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "coupled," "affixed," "connected," "interconnected," and the like refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features.

FIG. 1 illustrates an example of an oral care implement 100, in this case a manual tooth brush, having an oral treatment device (in this example a brush section) 200 and a grip section 300. Brush section 200 is removably attached to grip section 300 so that brush section 200 can be removed and replaced by a new brush section 200 when needed or desired. Brush section 200 will usually wear out, or need replacing for other reasons, long before grip section 300 will need replacing. By having a replaceable brush section, the user can use a more expensive grip section without incurring the expense of replacing the grip section every time the brush section needs replacing. For example, a user may want a particular grip section because of its appearance, feel, or gripping qualities. A user having a hand and fingers of a particular shape and/or size, or a user that is missing one or more fingers, may purchase a grip section that it particularly suited to their physical requirements. These grip sections can be expensive and therefore it is desirable to not have to replace the grip section every time the brush section needs replacing. Also, by providing a replaceable brush section, many combinations of grip sections and brush sections can be available without having to manufacture every possible grip section/brush section combination as a single unit.

Referring again to FIG. 1, in this example brush section 200 has a plurality of bristles 290. Other examples have more or fewer bristles, a different configuration of bristles, or a cleaning element that is other than bristles. In the example shown, brush section 200 is approximately 50% of the total length of the toothbrush. In other examples, brush section 200 is between 30% and 60% of the total length of the toothbrush. In still other examples, brush section 200 is between 40% and 50% of the total length of the toothbrush. By making brush section 200 a significant portion of the total length of the toothbrush, brush section 200 is larger than some other designs and, as a result, is more difficult to misplace. In addition, by making brush section 200 a larger portion of the total length of the toothbrush, grip section 300 can be made shorter, resulting in the disassembled tooth brush being easier to store.

Figure 2:
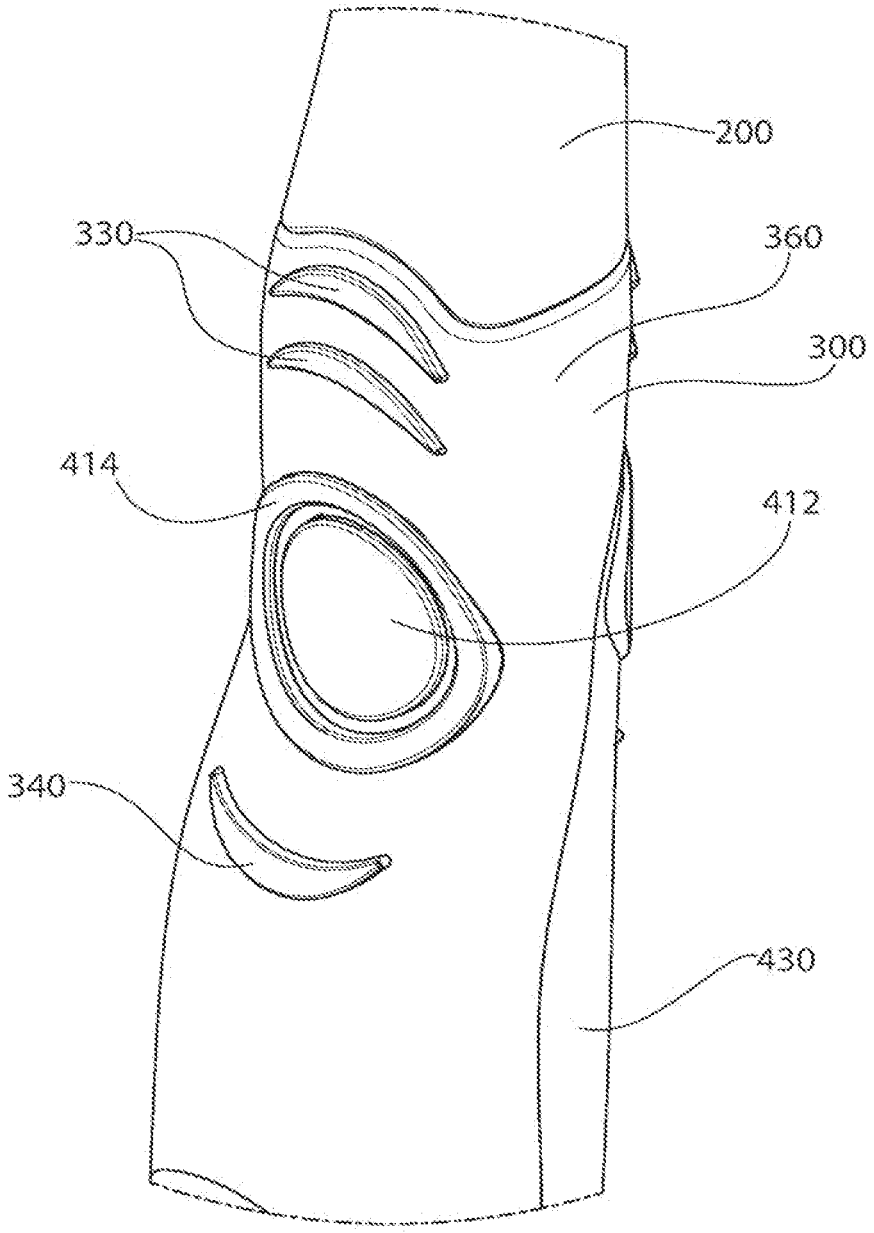
FIG. 2 is a close-up view of the oral care implement shown in FIG. 1.

Grip section 300 in this example has a plurality of gripping features. As shown in FIGS. 1-4, grip section 300 has a body 310 and a pad unit 400. Body 310 in this example is made of a hard thermoplastic (TP) and pad unit 400 in this example is made of a softer material than body 310. For example, pad unit 400 can be made of a resilient material such as a thermoplastic elastomer (TPE) in order to provide a more pleasing and comfortable feel to the user. FIG. 4 shows pad unit 400 separate from body 310 to more clearly show what portions of grip section 300 are, in this example, a resilient material. Grip section 300 can, for example, be manufactures by placing body 310 in a mold and injecting TPE into body 310 and the mold to form pad unit 400. Although in this example pad unit 400 is a single unit, in other examples the various parts of pad unit 400 are formed as two or more separate pieces. Referring to FIG. 2, an upper section 360 of grip section 300 include two upper front grip features 330 and a lower front grip feature 340. FIG. 4 shows a palm section 320 that is located in a lower section of body 310. Upper front grip features 330, lower front grip feature 340, and palm section 320 are, in this example, a part of body 310 and are therefore a harder material than the gripping features of pad unit 400. Also shown in FIG. 2 is a thumb pad 410 that includes an inner thumb pad 412 and an outer thumb pad 414 that provide a soft area for the user to place thumb pressure on the toothbrush during use. FIG. 4 shows a void 350 in body 310 that is filled with the TPE to form thumb pad 410. The number and placement of the various grip features and pads are exemplary only and should not be considered limiting. Other numbers, shapes, sizes, and locations of grip features and pads can also be used. Also, gripping features shown as part of body 310 can alternatively be part of pad unit 400, and vice versa. In this example, grip section 300 is solid. However, other examples can be hollow and/or made from materials other than a TP material. For example, grip section 300 can be made from a metal, a wood, a composite material, or any other material.

Figure 3:
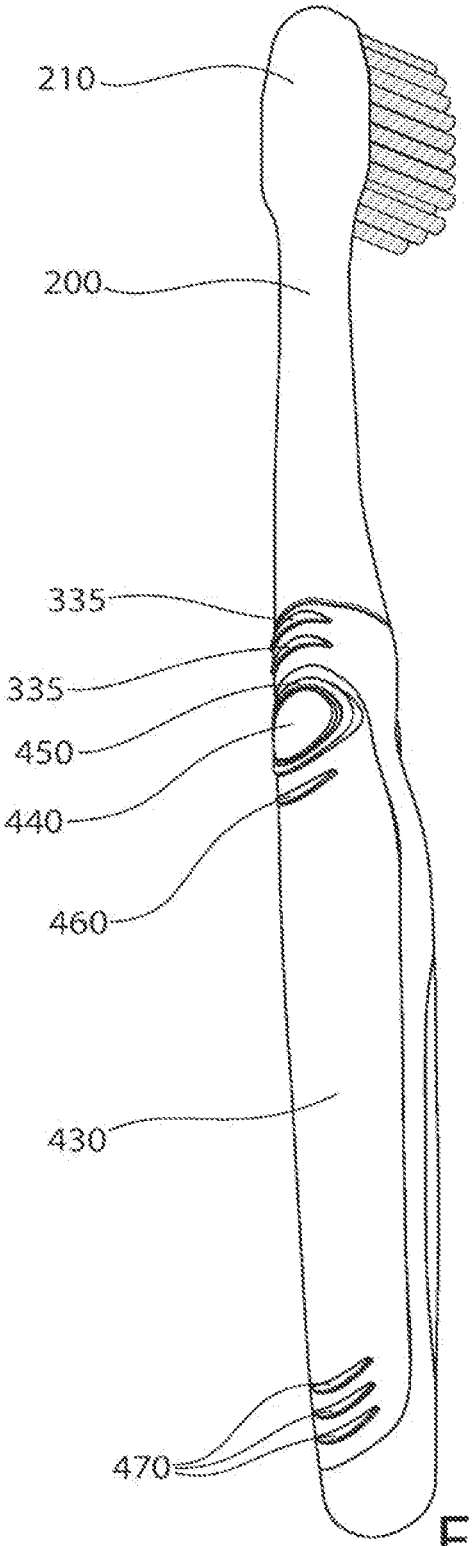
FIG. 3 is a rear perspective view of the oral care implement shown in FIG. 1.
Figure 4:
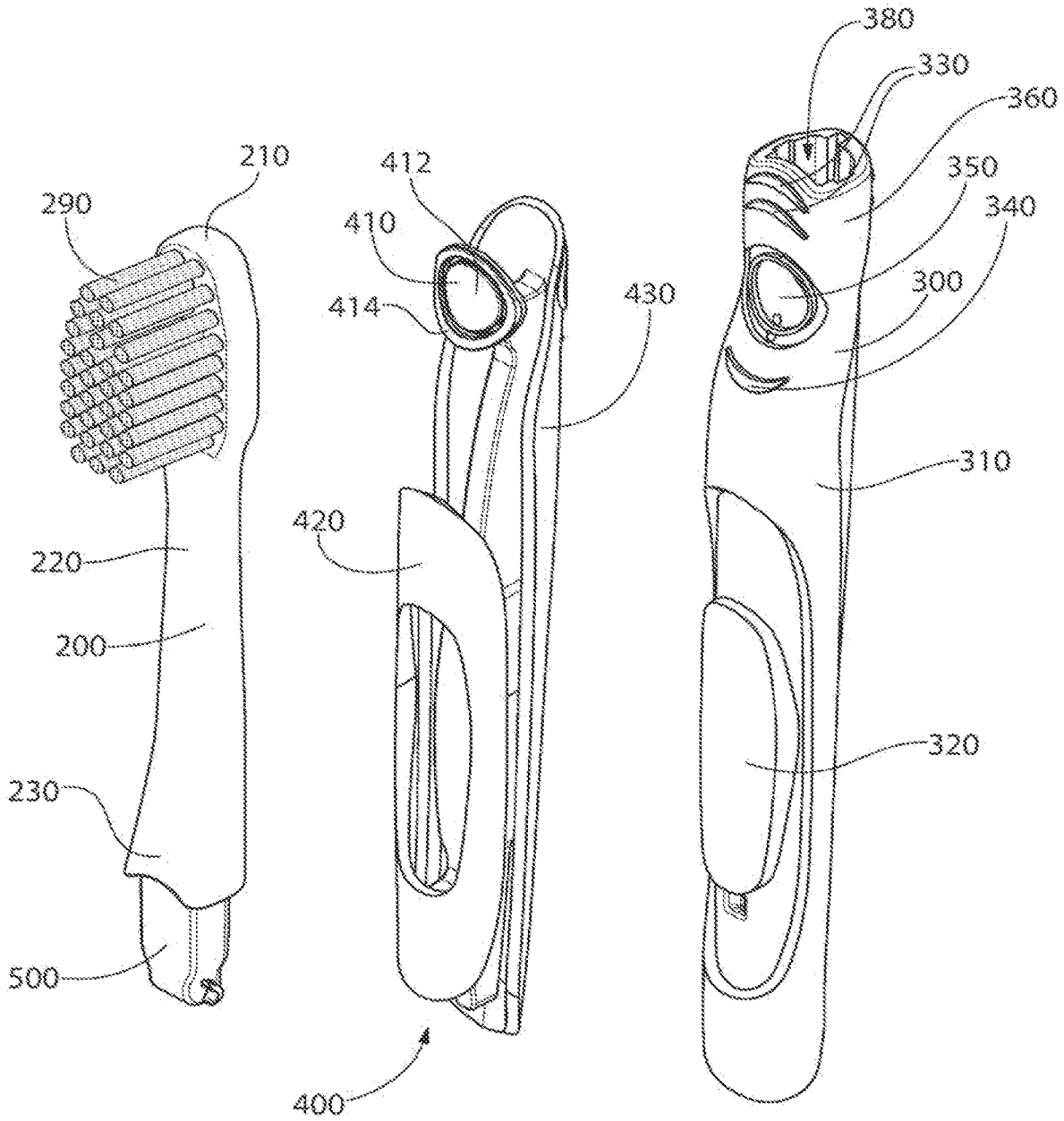
FIG. 4 is a front perspective disassembled view of the oral care implement shown in FIG. 1.

FIG. 3 shows an example of gripping features located on the rear side of the toothbrush. Gripping features molded into body 310 include two upper rear grip features 335. Gripping features molded as part of pad unit 400 include an inner index finger pad 440, an outer index finger pad 450, a middle rear grip feature 460, a lower finger pad 430, and three lower rear grip features 470. The number and placement of the various grip features and pads are exemplary only and should not be considered limiting. Other numbers, shapes, sizes, and locations of grip features and pads can also be used. Also, gripping features shown as part of body 310 can alternatively be part of pad unit 400, and vice versa.

Referring to FIG. 4, brush section 200 is shown having a head 210 from which bristles 290 extend, a shaft portion 220, and a lower section 230. Extending from lower section 230 is a connection portion 500 that provides a secure connection to grip section 300 by its interaction with a connection receptacle 380 in the end of grip section 300. The engagement of connection portion 500 and connection receptacle 380 provides a connection that is hidden from view in the assembled state and that securely and removably attaches brush section 200 to grip section 300.

Figure 5:
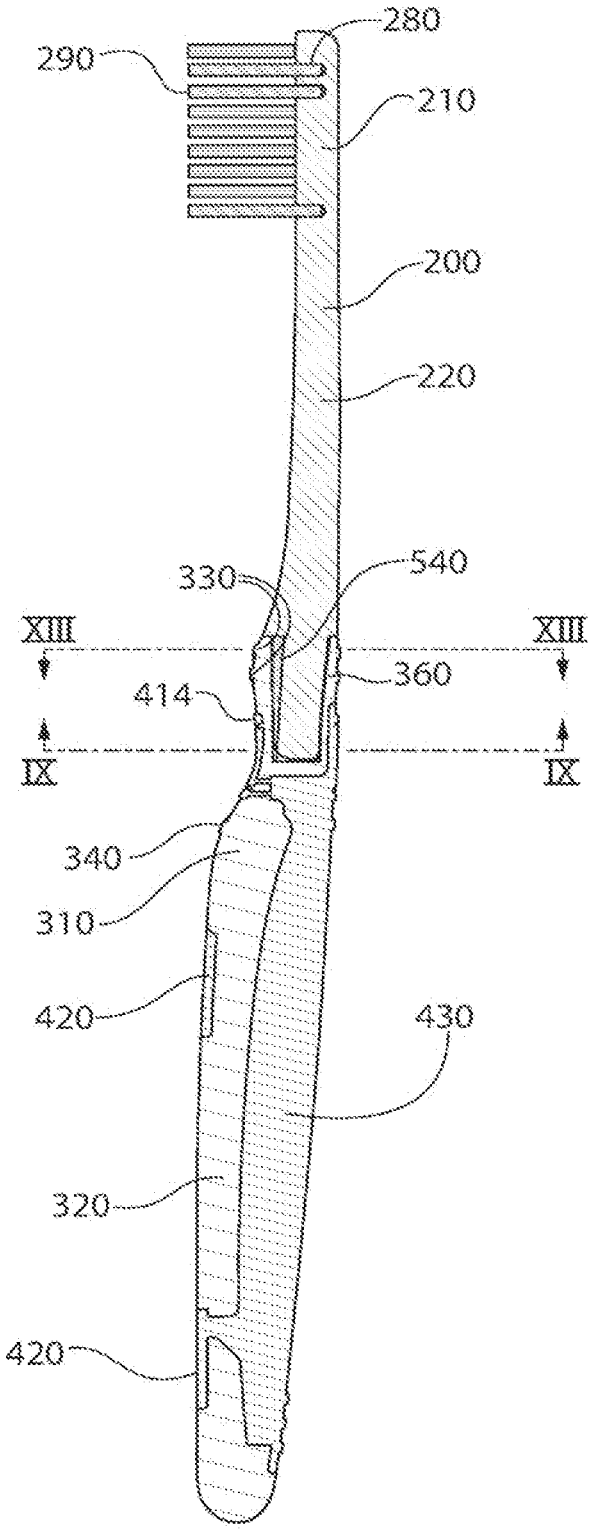
FIG. 5 is a side sectional view of the oral care implement shown in FIG. 1.

FIG. 5 shows a sectional view of brush section 200 and grip section 300 in the assembled state. This view shows three bristle anchoring portions 280 (in this example, holes in which bristles 290 are fixed by gluing or other means) in head 210.

Figure 6:
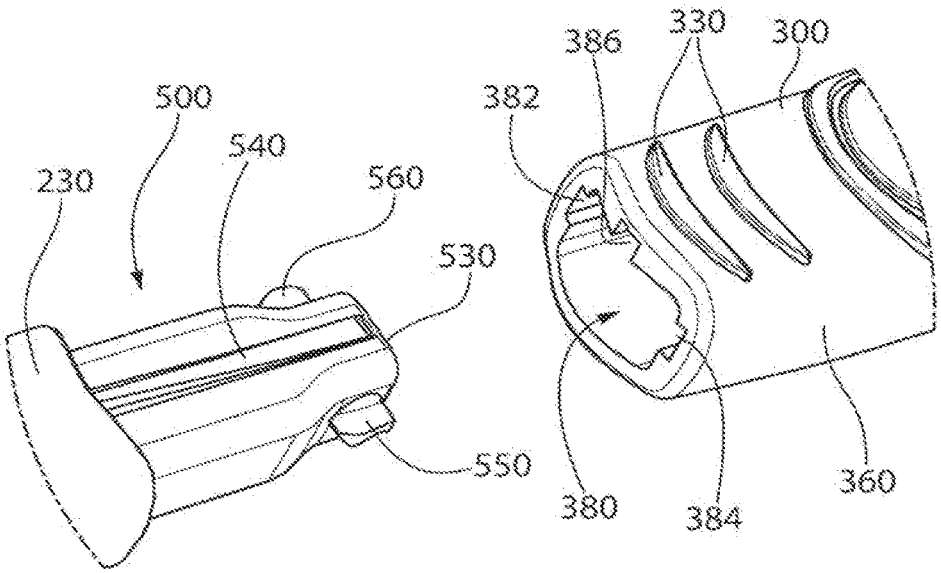
FIG. 6 is a perspective view of an attachment section of the oral care implement shown in FIG. 1.
Figure 7:
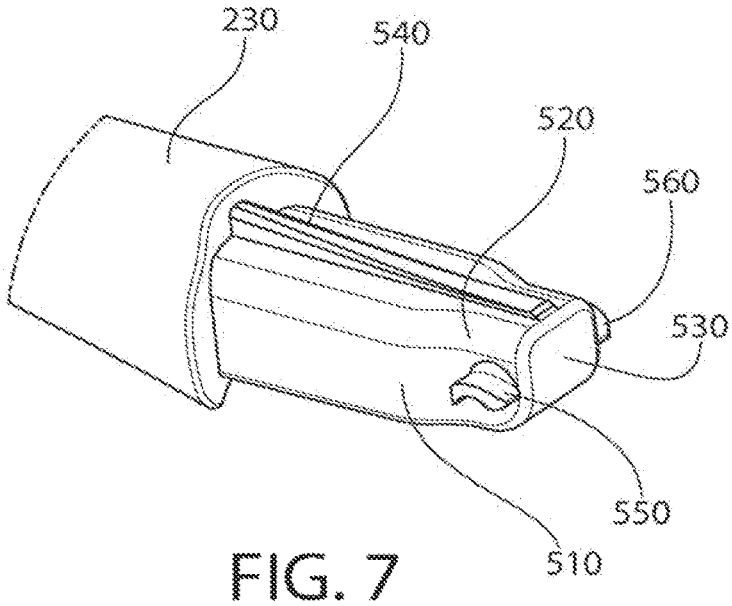
FIG. 7 a perspective view of an attachment section of the oral care implement shown in FIG. 1.
Figure 8:
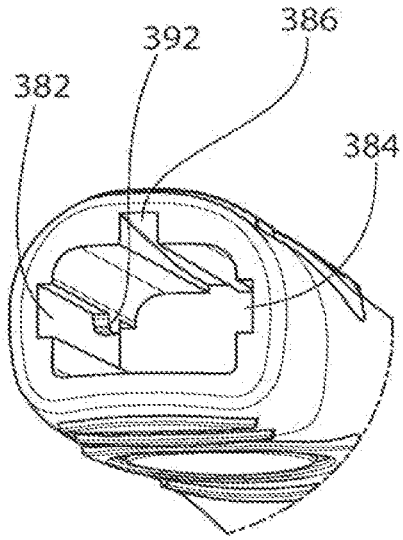
FIG. 8 is a perspective view of an attachment section of the oral care implement shown in FIG. 1.

FIGS. 6-8 show the connection between brush section 200 and grip section 300 in more detail. Connection portion 500 has, in this example, a main body 510 and two resilient snap attachments 550, 560 extending laterally from an end 530 of connection portion 500. Resilient snap attachments 550, 560 can be individually formed pieces or they can be ends of a single piece. Resilient snap attachment 550 is received in a recess 384 in connection receptacle 380, while, similarly, resilient snap attachment 560 is received in a recess 382, as connection portion 500 is inserted into connection receptacle 380. As shown in FIG. 8, recess 382 has an engagement portion 392 that interacts with resilient snap attachment 560 (explained below). A similar interaction takes place between resilient snap attachment 550 and an engagement portion 394 in recess 384. In this example, connection portion 500 also has a rib 540 extending from a surface of connection portion 500. Rib 540 can be a resilient material, a hard plastic, or some other material and is received in a groove 386 in connection receptacle 380 to help locate connection portion 500 properly in connection receptacle 380. In some examples, rib 540 exerts pressure on connection receptacle 380 to help prevent rocking between brush section 200 and grip section 300.

Main body 510 of connection portion 500 may be formed of a hard plastic. Suitable hard plastics include, without limitation, polyethylene, polypropylene (PP), polyamide, polyester, cellulosics, SAN, acrylic, ABS, butadiene, vinyl compounds, and polyesters such as polyethylene terephthalate, or any other of the commonly known thermoplastics used in toothbrush manufacture. Resilient snap attachments 550, 560 can be formed of a resilient/elastomeric material, such as for example without limitation a thermoplastic elastomer. In some embodiments, the hard plastic parts have a hardness on a given hardness scale that is higher than the hardness of the resilient parts.

In this example, as shown in FIG. 7, end 530 of connection portion 500 has a radiused lower area in order to provide a locating function when connection portion 500 is first inserted into connection receptacle 380.

As shown in FIG. 7, rib 540 can have a height that varies along the longitudinal axis of main body 510 of connection portion 500. In the example shown, the height of rib 540 increases continuously from end 530 of connection portion 500 to lower section 230 of brush section 200. Similarly, in this example, a depth of groove 386 changes continuously, as shown in FIG. 8. Rib 540 and groove 386 can provide a locating function between connection portion 500 and connection receptacle 380 to ensure that brush section 200 is attached in the correct orientation relative to grip section 300. Rib 540 and groove 386 can also provide a stabilizing force against each other to maintain a secure fit between brush section 200 and grip section 300 that prevents relative movement between brush section 200 and grip section 300. The slope of the upper surface of rib 540 can be uniform to provide a flat upper surface, or it can increase along its length to provide a curved upper surface.

FIGS. 6 and 7 show fillets 520 on either side of the top of connection portion 500. Fillets 520 provide a guiding function for the insertion of connection portion 500 into connection receptacle 380. Fillets 520 can have a different radius than the opposite (lower) corners of connection portion 500 in order to further prevent brush section 200 being attached to grip section 300 in an incorrect orientation.

FIG. 8 shows the, in this example, connection receptacle 380 is somewhat rectangular in cross-section with the corners rounded to at least substantially match the fillets of connection portion 500. Recess 382 is a rectangular groove cut into one of the side walls of connection receptacle 380 in order to allow resilient snap attachment 560 to slide into connection receptacle 380 so that resilient snap attachment 560 comes into contact with engagement portion 392. Similarly, recess 384 is a rectangular groove cut into the opposite side wall of connection receptacle 380 in order to allow resilient snap attachment 550 to slide into connection receptacle 380 so that resilient snap attachment 550 comes into contact with engagement portion 394. This example also includes groove 386 being cut into an upper wall of connection receptacle 380. Groove 386 has a rectangular cross-section that gets smaller as it progresses farther into connection receptacle 380 due to the upper surface of groove 386 sloping downward, as shown in FIG. 8. The shape of groove 386 can be identical to the shape of rib 540 or it can be shaped, for example slightly smaller than rib 540, so that rib 540 is biased by contact with groove 386 in the assembled position.

Figure 9:
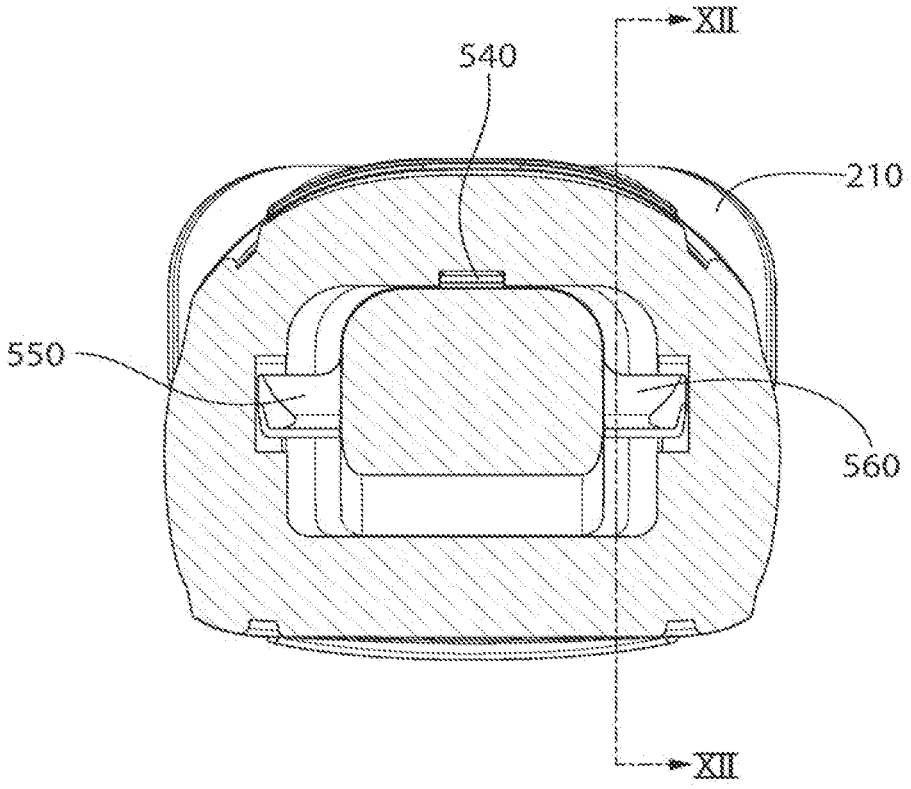
FIG. 9 a sectional view of the oral care implement shown in FIG. 1, taken along section line IX-IX of FIG. 5.
Figure 10:
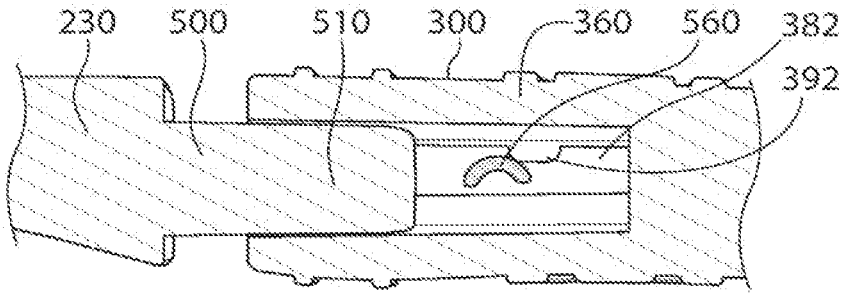
FIG. 10 is a partial side sectional view of the oral care implement shown in FIG. 1 in a first insertion position.
Figure 11:
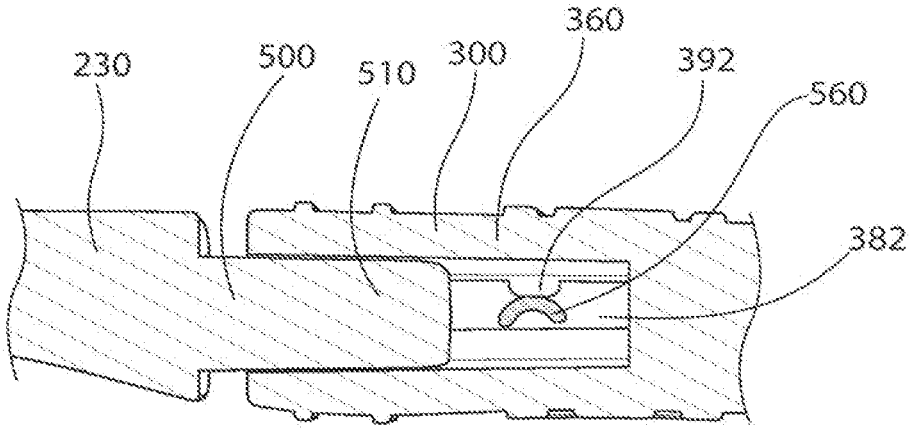
FIG. 11 is a partial side sectional view of the oral care implement shown in FIG. 1 in a second insertion position.
Figure 12:
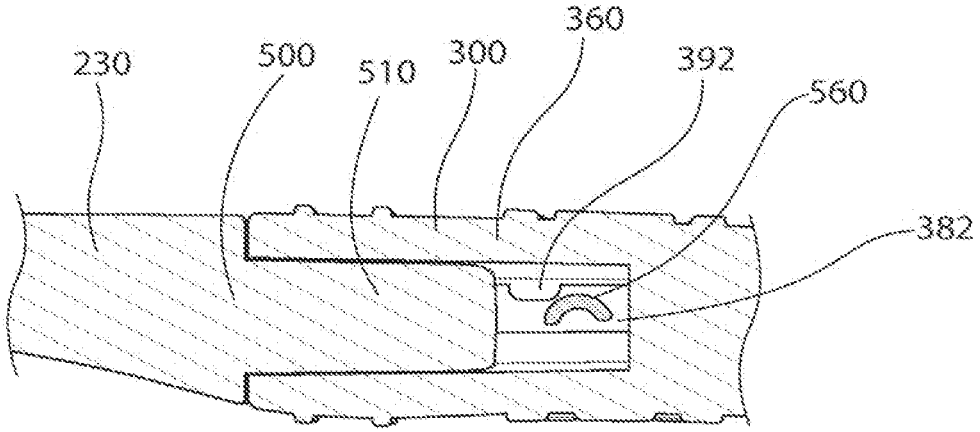
FIG. 12 is a partial side sectional view of the oral care implement shown in FIG. 1 in a fully inserted position, taken along section line XII-XII of FIG. 9.

FIG. 9 is a sectional view along section line IX-IX in FIG. 5 and shows connection portion 500 inserted into connection receptacle 380. Section line XII-XII in FIG. 9 shows the line along which the sections shown in FIGS. 10-12 are taken. In FIG. 9, connection portion 500 is fully inserted into connection receptacle 380 such that brush section 200 and grip section 300 are in the assembled position. FIG. 12 corresponds to the assembled position, whereas FIGS. 10 and 11 show partial insertion. The interaction of resilient snap attachment 560 and engagement portion 392 will now be explained with reference to FIGS. 10-12. The interaction between resilient snap attachment 550 and engagement portion 394 is similar and takes place simultaneously with that of resilient snap attachment 560 and engagement portion 392.

FIG. 10 shows connection portion 500 partially inserted into connection receptacle 380 to the point where resilient snap attachment 560 begins to contact engagement portion 392. At this point the user will feel resistance to further insertion due to the interference of resilient snap attachment 560 and engagement portion 392. As connection portion 500 is pushed farther into connection receptacle 380 (FIG. 11), resilient snap attachment 560 is deflected (downward in this view) as it is pressed downward by the more rigid engagement portion 392. Resilient snap attachment 560 is crescent shaped in this example and can deflect in various ways, including becoming less convex and/or being pushed away from engagement portion 392. As connection portion 500 is pushed farther into connection receptacle 380, resilient snap attachment 560 snaps back into (or substantially into) its original position and shape on the other side of engagement portion 392 (FIG. 12). In some embodiments, in the assembled state one or both of resilient snap attachments 550, 560 are biased into contact with their respective engagement portions 394, 392. In the assembled state shown in FIG. 12, brush section 200 is securely attached to grip section 300. Brush section 200 and grip section 300 will remain in the assembled state through normal use and will only be separated upon the exertion of a pulling force (in the longitudinal direction of the toothbrush) that is large enough to deflect resilient snap attachments 550, 560 so that they can move past engagement portions 394, 392, respectively.

In this example, resilient snap attachments deflect in a circumferential direction (downward in these views) as they move past engagement portions 392, 394. The pointed leading edge of resilient snap attachments 550, 560 (shown in FIG. 7) provide for easy deflection as resilient snap attachments 550, 560 first contact engagement portions 392, 394. The thickening of resilient snap attachments 550, 560 as you move away from the leading edge requires increased force to deflect resilient snap attachments 550, 560 and, as a result, provides a secure connection.

Figure 13:
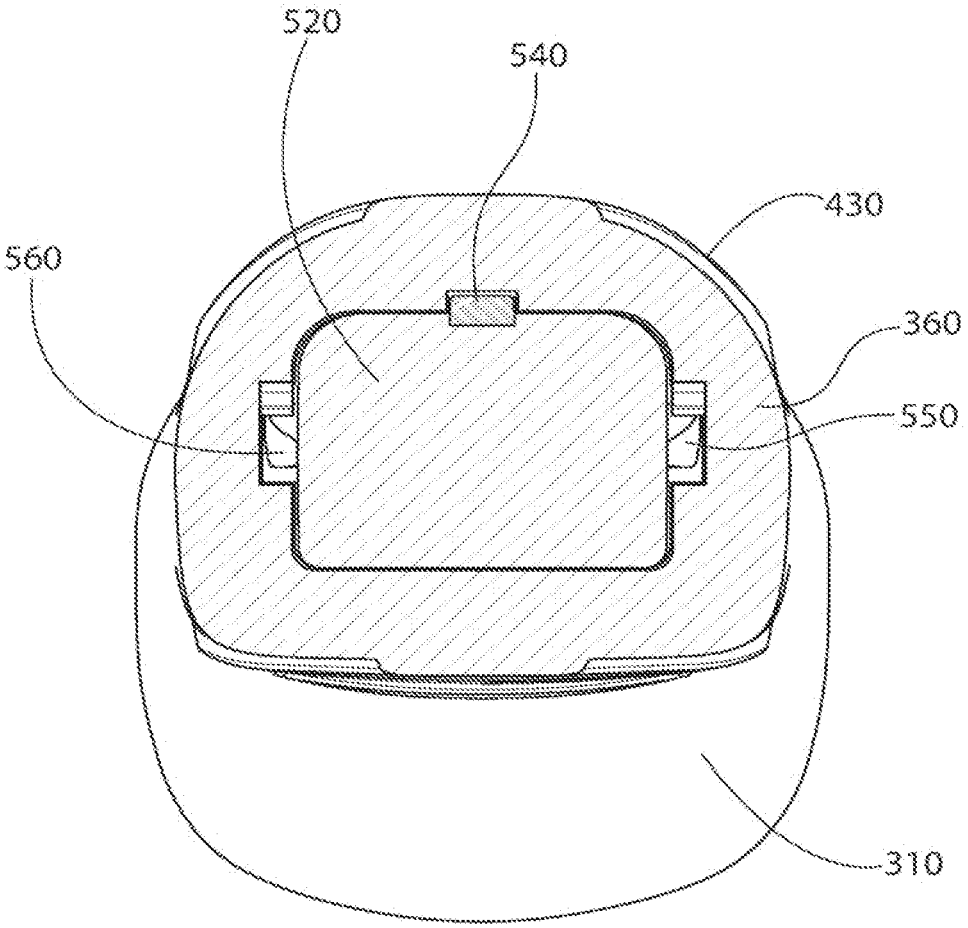
FIG. 13 a sectional view of the oral care implement shown in FIG. 1, taken along section line XIII-XIII of FIG. 5.
Figure 14:
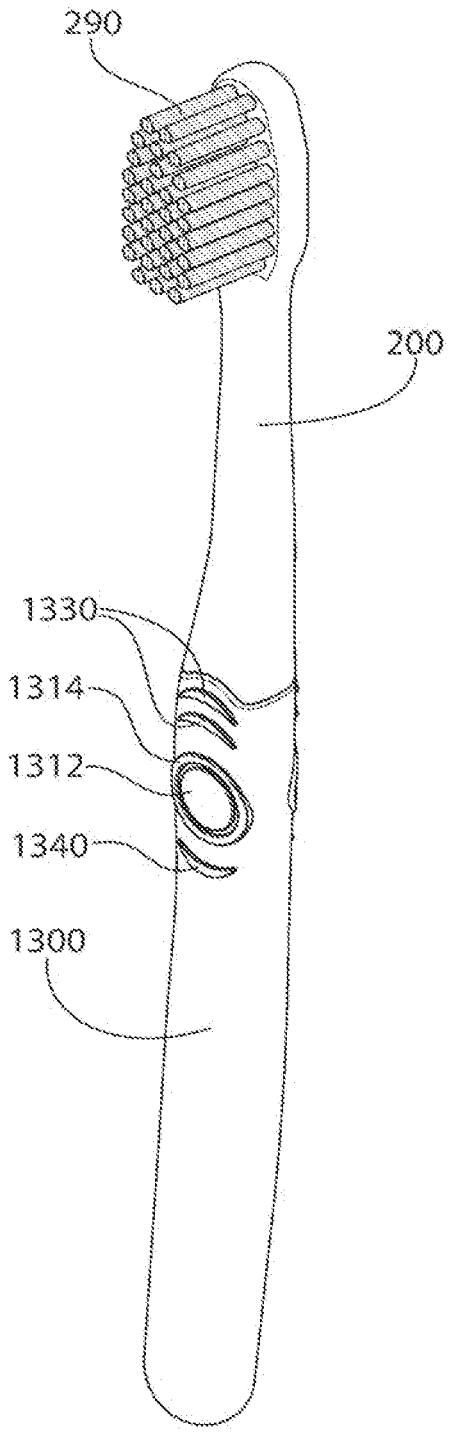
FIG. 14 is a front perspective view of an oral care implement according to exemplary embodiments of the invention.
Figure 15:
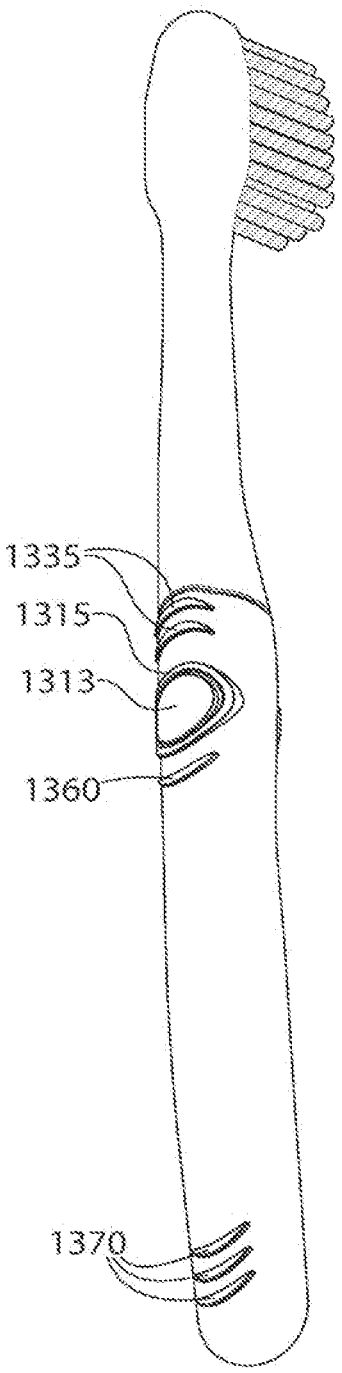
FIG. 15 is a rear perspective view of the oral care implement shown in FIG. 14.

FIG. 13 is a sectional view along section line XIII-XIII in FIG. 5. FIG. 13 shows the position of connection portion 500 in connection receptacle 380 at a location of connection portion 500 that has a larger cross section than the location shown in FIG. 9.

While the connection between brush section 200 and grip section 300 is explained above with brush section 200 having the male portion of the connection (connection portion 500) and grip section 300 having the female portion of the connection (connection receptacle 380), other embodiments reverse this. In some embodiments, the brush section has the female portion (for example, connection receptacle 380) and the grip section has the male portion (for example, connection portion 500). Various things can influence which orientation of the connection portion and the connection receptacle is best in a particular application. For example, if the brush section has no resilient material, and the connection portion includes resilient material, then it may be beneficial to construct the connection receptacle on the brush portion so that manufacturing the brush portion is made less expensive due to there being no need for any resilient material. In addition, because a protrusion is generally more easily cleaned than a recess, locating the recess on the replaceable portion of the implement (the brush section), could result in a more easily cleanable permanent portion (the grip section).

FIGS. 14-18 show one of many alternate embodiments of grip sections that can be used with brush section 200. Brush section 200 is the same as described above. Grip section 1300 is a simpler design as compared to grip section 300. Grip section 1300 can be a grip section used for travel or other situations where a simpler and/or smaller grip section is desired. Unlike grip section 300, grip section 1300 is made entirely of one material and, in this example, has no TPE portions like pad unit 400. By making grip section 1300 of one material, it can be less expensive to manufacture than a multi-material grip section like grip section 300.

In the example shown in FIGS. 14-18, grip section 1300 has two upper front grip features 1330, an inner thumb pad 1312, an outer thumb pad 1314, and a lower front grip feature 1340 on its front side. In this example, grip section 1300 has two upper rear grip features 1335, an inner index finger pad 1313, an outer index finger pad 1315, a middle rear grip feature 1360, and three lower rear grip features 1370 on its rear side. The number and placement of the various grip features and pads are exemplary only and should not be considered limiting. Other numbers, shapes, sizes, and locations of grip features and pads can also be used.

Figure 16:
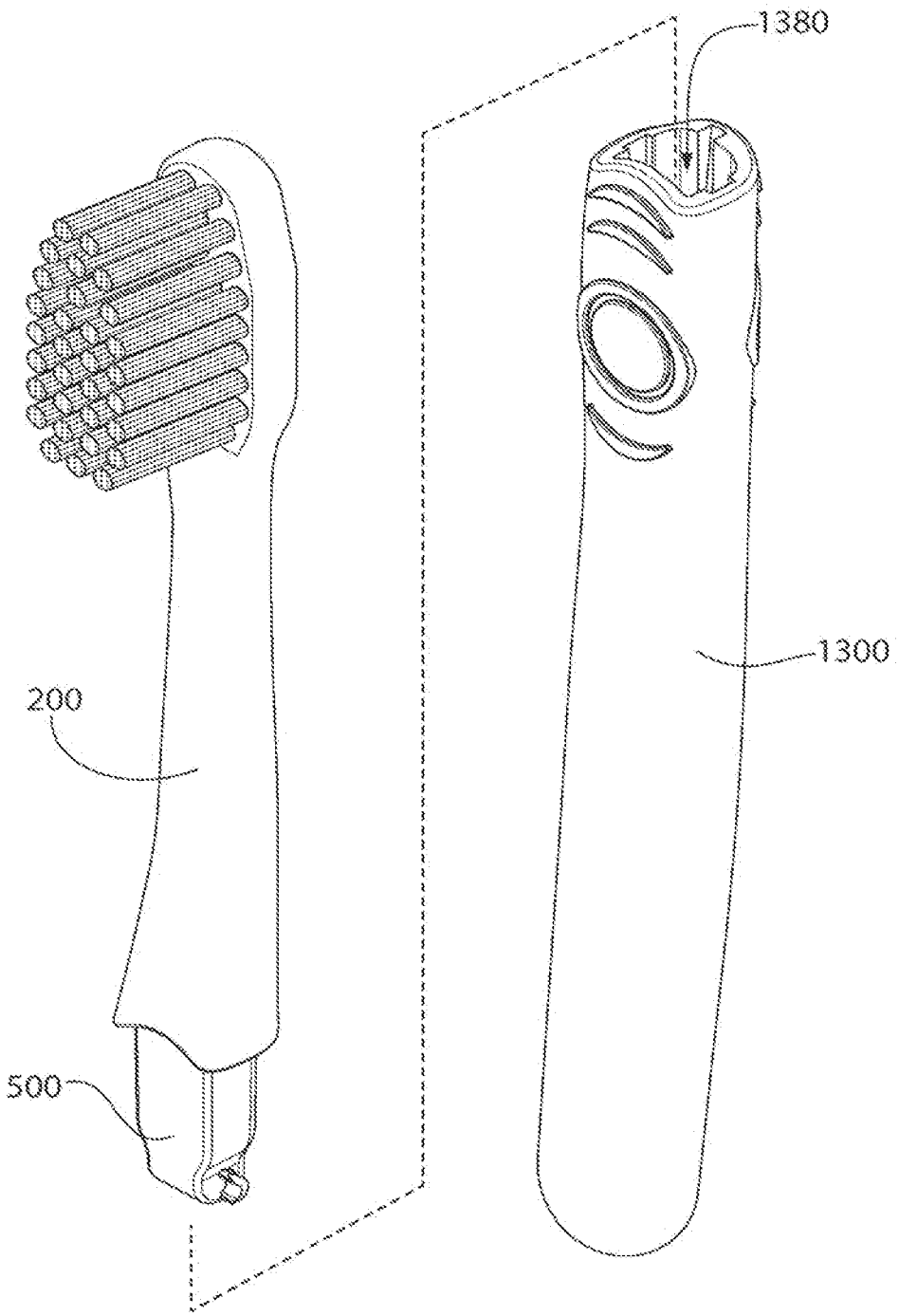
FIG. 16 is a front perspective disassembled view of the oral care implement shown in FIG. 14.
Figure 17:
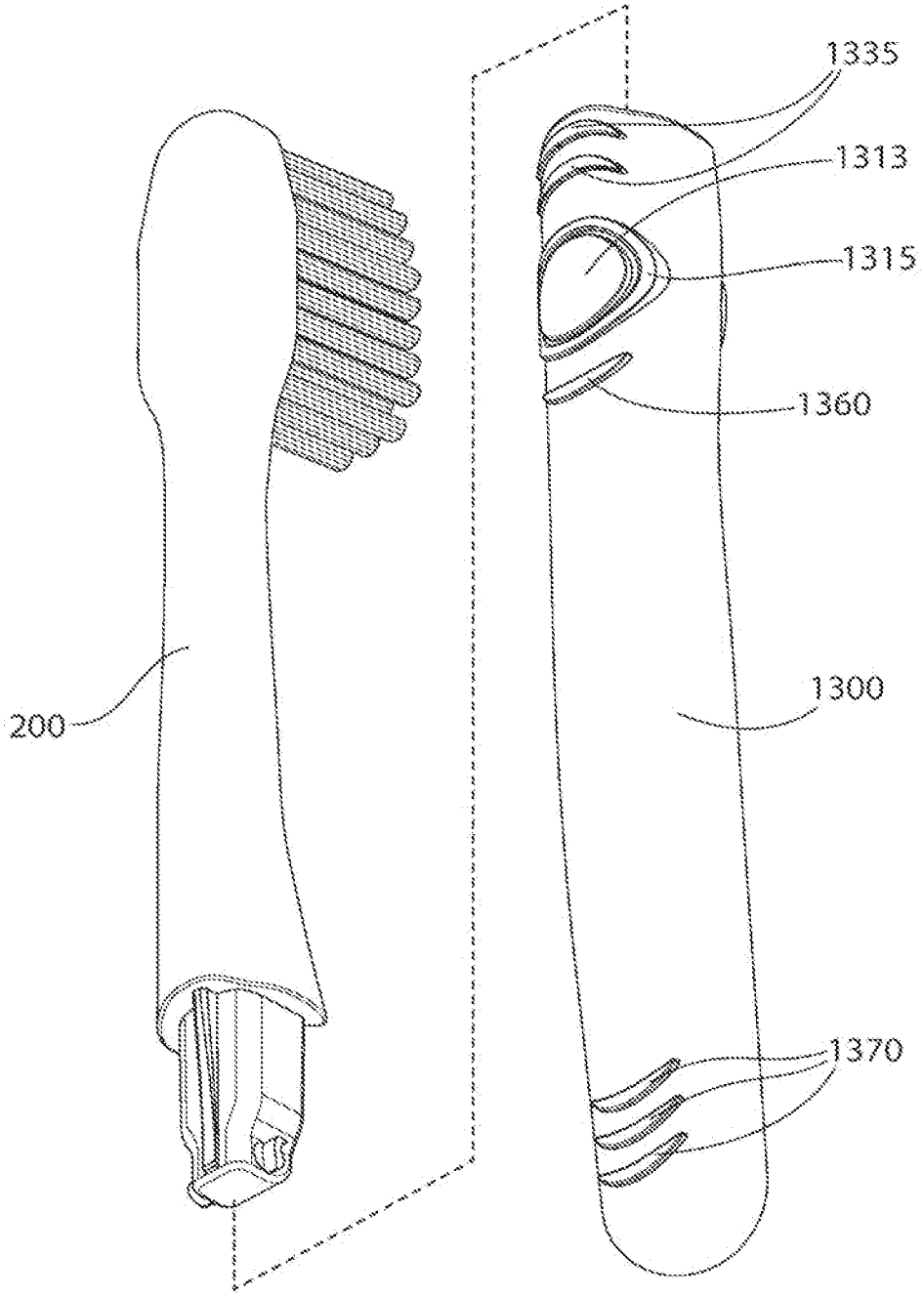
FIG. 17 is a rear perspective disassembled view of the oral care implement shown in FIG. 14.

FIGS. 16 and 17 show grip section 1300 having a connection receptacle 1380 that is, in this example, identical to connection receptacle 380 discussed above. As a result, connection receptacle 1380 and connection portion 500 provide the same secure connection that connection receptacle 380 and connection portion 500 provide (as discussed above).

Figure 18:
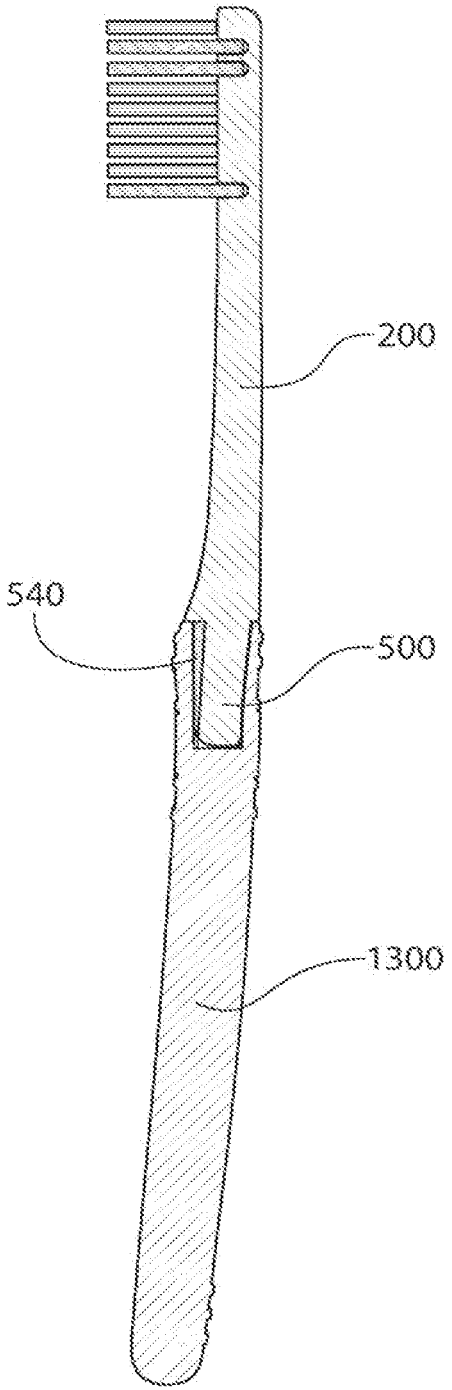
FIG. 18 is a side sectional view of the oral care implement shown in FIG. 14.

FIG. 18 is a sectional view of brush section 200 and grip section 1300 in the assembled state. In this example, grip section 1300 is solid and is made from a TP material. However, other examples can be hollow and/or made from materials other than a TP material. For example, grip section 1300 can be made from a metal, a composite material, or any other material.

While the invention has been described with connection portion 500 being a part of brush section 200 and connection receptacle 380 being a part of grip section 300, it is noted that these can be switched such that connection portion 500 can be a part of grip section 300 and connection receptacle 380 can be a part of brush section 200.

While the invention has been described with connection portion 500 being part hard plastic and part resilient material, and with connection receptacle 380 being all hard plastic, it is noted that other combinations of hard plastic (or other hard materials) and resilient material can be used. For example, connection portion 500 can be entirely hard plastic and portions (for example, engagement portions 392, 394) of connection receptacle 380 can be resilient.

As can be seen from this disclosure, the invention provides a solution to at least the problem of securely connecting a replaceable treatment device to a grip section of an oral care implement.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A personal care implement comprising:

a treatment device having a proximal end, a distal end opposite the proximal end, and a longitudinal axis, the treatment device comprising:

a treatment portion that comprises the proximal end of the treatment device, the treatment portion having at least one treatment element;

a connection portion that comprises the distal end of the treatment device, the connection portion having a main body, a first resilient snap attachment protruding from the main body, and a locating rib protruding from the main body, the locating rib protrudes a height in a radial direction from the main body, the height of the locating rib increasing with longitudinal distance from the distal end of the treatment device in a direction towards the proximal end of the treatment device; and a grip section;

wherein the treatment device is alterable between: (1) a detached state; and (2) an assembled state in which the treatment device is detachably coupled to the grip section such that the first resilient snap attachment cooperates with and engages a first engagement portion of the grip section to secure the treatment device to the grip section.

2. The personal care implement according to claim 1 wherein the treatment device is an oral treatment device, the treatment portion is an oral insertion portion, and the treatment element is an oral treatment element.

3. The personal care implement according to claim 1 further comprising a second resilient snap attachment protruding from the main body, wherein the second resilient snap attachment is configured to cooperate with and engage a second engagement portion of the grip section to secure the treatment device to the grip section.

4. The personal care implement according to claim 3 wherein the connection portion is configured such that during transition from the detached state to the assembled state, the first resilient snap attachment is deflected to a first degree by the first engagement portion to allow the first resilient snap attachment to pass by the first engagement portion, and is deflected to a degree less than the first degree after it passes by the first engagement portion such that removal of the treatment device from the grip section is impeded by the first resilient snap attachment contacting the first engagement portion, and the connection portion is configured such that during transition from the detached state to the assembled state, the second resilient snap attachment is deflected to a first degree by the second engagement portion to allow the second resilient snap attachment to pass by the second engagement portion, and is deflected to a degree less than the first degree after it passes by the second engagement portion such that removal of the treatment device from the grip section is impeded by the second resilient snap attachment contacting the second engagement portion.

5. The personal care implement according to claim 1 wherein the locating rib comprises an upper surface with an upper surface width, the upper surface width decreasing along the longitudinal axis of the treatment device as the height of the locating rib increases.

6. The personal care implement according to claim 1 wherein the main body of the connection portion comprises an outer surface having a first set of fillets having a first fillet radius and a second set of fillets having a second fillet radius, the first set of fillets being opposite the second set of fillets on the outer surface, and the first fillet radius being greater than the second fillet radius.

7. The personal care implement according to claim 1 wherein the locating rib is a resilient material.

8. The personal care implement according to claim 1 wherein the main body is a first material and the resilient snap attachments are a second material, and the first material and the second material are materials having different hardnesses.

9. The personal care implement according to claim 1 wherein the resilient snap attachments are crescent shaped.

10. The personal care implement according to claim 1 wherein the resilient snap attachments are deflectable in a circumferential direction relative to the longitudinal direction.

11. The personal care implement according to claim 1 wherein the grip section has a longitudinal axis.

12. The personal care implement according to claim 11 wherein the grip section further comprises a groove configured to receive the locating rib, and the groove has a depth in a radial direction, and the depth of the groove continuously changes from one end of the groove to another end of the groove.

13. The personal care implement according to claim 12 wherein the depth of the groove continuously increases from the one end of the groove to the other end of the groove.

14. A personal care implement comprising:

a treatment device having a proximal end, a distal end opposite the proximal end, and a longitudinal axis, the treatment device comprising:

a treatment portion having at least one treatment element that comprises the proximal end of the treatment device;

a connection receptacle that comprises the distal end of the treatment device, the connection receptacle having a first recess located in a first inside surface of the connection receptacle, a first engagement portion located in the first recess, and a rib receiving groove located in a third inside surface of the connection receptacle, the third inside surface and the first inside surface being different surfaces;

the first engagement portion extends circumferentially relative to the longitudinal axis;

the groove extends into the third inside surface a depth in a radial direction, the depth of the groove decreasing with longitudinal distance from an entrance of the connection receptacle at the distal end of the treatment device in a direction towards the proximal end of the treatment device; and a grip section comprising a connection portion;

wherein the treatment device is alterable between: (1) a detached state; and (2) an assembled state in which the treatment device is detachably coupled to the grip section such that the first engagement portion cooperates with and engages a first resilient snap attachment of the connection portion of the grip section to secure the treatment device to the grip section; and the groove is configured to receive a locating rib that protrudes a height in a radial direction from a main body of the connection portion, the height of the locating rib increasing with longitudinal distance from a distal end of the connection portion.

15. The personal care implement according to claim 14, wherein the treatment device is an oral treatment device, the treatment portion is an oral insertion portion, and the treatment element is an oral treatment element.

16. The personal care implement according to claim 14, wherein the connection receptacle is configured such that during transition from the detached state to the assembled state, the first resilient snap attachment is deflected to a first degree in a first circumferential direction by the first engagement portion to allow the first resilient snap attachment to pass by the first engagement portion, and is deflected to a degree in the first circumferential direction less than the first degree after it passes by the first engagement portion such that removal of the treatment device from the grip section is impeded by the first resilient snap attachment contacting the first engagement portion.

17. The personal care implement according to claim 14, further comprising the grip section, the grip section having a longitudinal axis.

18. The personal care implement according to claim 17, further comprising a locating rib protruding from the main body of the connection portion.

19. The personal care implement according to claim 18, wherein the locating rib is a resilient material.

20. The personal care implement according to claim 18, wherein the rib has a height in the radial direction that is different at different points along the longitudinal axis.

* * * * *